US007665231B2

(12) United States Patent
Abadjian et al.

(10) Patent No.: US 7,665,231 B2
(45) **Date of Patent: *Feb. 23, 2010**

(54) SKATEBOARD SHOE

(76) Inventors: Joseph Haroutioun Abadjian, 403 Los Arbolitos, Oceanside, CA (US) 92058; Wei-En Chang, 3259 Highview Dr., San Diego, CA (US) 92014

( * ) Notice: Subject to any disclaimer, the term of this patent is extended or adjusted under 35 U.S.C. 154(b) by 0 days.

This patent is subject to a terminal disclaimer.

(21) Appl. No.: 12/243,918

(22) Filed: Oct. 1, 2008

(65) Prior Publication Data

US 2009/0049714 A1 Feb. 26, 2009

Related U.S. Application Data

(63) Continuation of application No. 11/282,559, filed on Nov. 18, 2005, now Pat. No. 7,430,817.

(51) Int. Cl.
*A43B 13/00* (2006.01)
*A43B 1/10* (2006.01)

(52) U.S. Cl. ..... 36/29; 36/25 R; 36/102

(58) Field of Classification Search ..... 36/29, 36/102, 28, 31, 30 R, 25 R
See application file for complete search history.

(56) References Cited

U.S. PATENT DOCUMENTS

| | | | | |
|---|---|---|---|---|
| 4,670,995 | A | 6/1987 | Huang | |
| 5,806,209 | A | 9/1998 | Crowley et al. | |
| 5,987,781 | A | 11/1999 | Pavesi et al. | |
| 6,009,637 | A | 1/2000 | Pavone | |
| 6,065,230 | A | 5/2000 | James | |
| 6,266,897 | B1 | 7/2001 | Seydel et al. | |
| 6,453,577 | B1 | 9/2002 | Litchfield et al. | |
| 6,516,540 | B2 | 2/2003 | Seydel et al. | |
| 6,915,594 | B2 | 7/2005 | Kim | |
| 7,430,817 | B2 * | 10/2008 | Abadjian et al. | 36/29 |
| 2004/0194343 | A1 | 10/2004 | Kim | |
| 2004/0261293 | A1 | 12/2004 | Marvin et al. | |
| 2005/0262739 | A1 | 12/2005 | McDonald et al. | |

FOREIGN PATENT DOCUMENTS

| | | |
|---|---|---|
| DE | 2121667 | 11/1971 |
| WO | WO97/03582 | 2/1997 |
| WO | WO 00/57740 | 10/2000 |
| WO | WO 2004/028285 | 4/2004 |

* cited by examiner

*Primary Examiner*—Marie Patterson

(57) ABSTRACT

A skateboard shoe comprising a plurality of fluid chambers able to move and flex independently from one another along the bottom portion of the midsole is shown and described. The midsole acts as both a stabilizing midsole and an impact cushioning midsole while improving the fit of the shoe so it moves with the foot.

20 Claims, 8 Drawing Sheets

SKATEBOARD SHOE

CLAIM OF PRIORITY UNDER 35 U.S.C. §119

The present Application for Patent is a continuation of and claims priority to U.S. patent application Ser. No. 11/282,559 filed on Nov. 18, 2005 now U.S. Pat. No. 7,430,817, entitled "SKATEBOARD SHOE," and assigned to the assignee hereof and hereby expressly incorporated by reference herein.

BACKGROUND

1. Field

The devices and methods described below relate to skateboarding shoes and particularly to the design of the sole of skateboarding shoes.

2. Related Art

A skateboard is controlled primarily through the rider's feet. Greater control of a skateboard may be provided by appropriate footwear and allow the rider to perform more skateboard tricks, such as ollies, kickflips, and crooks, with a greater degree of mastery. Any shoe designed for use during skateboarding should be designed to allow flexibility of the rider's feet while appropriately gripping the skateboard. In other words, the shoe should be designed to account for the required flexibility used by a skateboard rider to control the skateboard. In addition, the shoe should be designed to provide the rider with comfort and a better grip of the skateboard.

Presently, the outsoles of skateboard shoes have a unitary design that allows little flexibility and movement. Outsoles are manufactured as a single unitary component from a single material such as a polymer. Outsoles may also be manufactured from several different materials bonded together to form a unitary structure. What is needed is a skateboard shoe with a segmented midsole and outsole that provides greater flexibility to the rider. The skateboard shoes described below have a structure that provides appropriate flexibility and grip between the shoe and a skateboard to allow a rider to perform skateboard tricks.

SUMMARY

The shoes described below provide for improved flexibility in shoe with an air cushion bladder in the sole or mid-sole. The sole of the shoe comprises a longitudinally and transversely segmented midsole and a longitudinally segmented outsole wherein the inner sole and outsole are segmented longitudinally at substantially the same locations. The segmentation of the midsole and the outsole allows the individual segments of the outsole to move and grip the skateboard independently from the other segments.

BRIEF DESCRIPTION OF THE DRAWINGS

The features, objects, and advantages of the invention will become more apparent from the detailed description set forth below when taken in conjunction with the drawings, wherein.

DETAILED DESCRIPTION

Methods and systems that implement the embodiments of the various features of the invention will now be described with reference to the drawings. The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment. Throughout the drawings, reference numbers are re-used to indicate correspondence between referenced elements.

Figure 1:
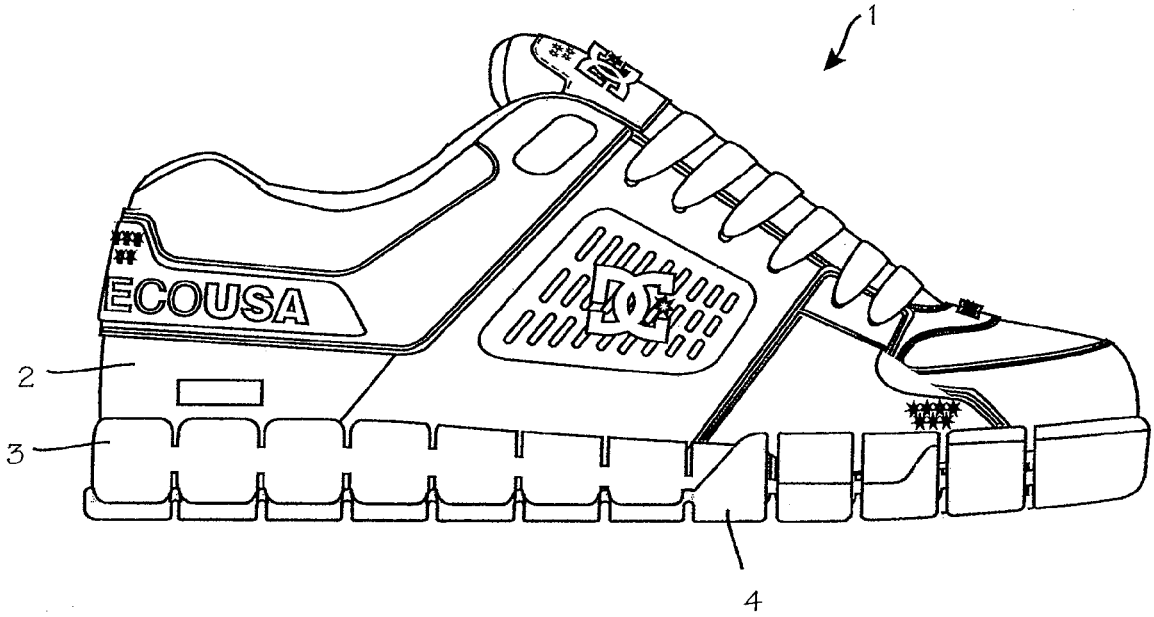
FIG. 1 illustrates a lateral view of a right foot skateboard shoe.
Figure 2:
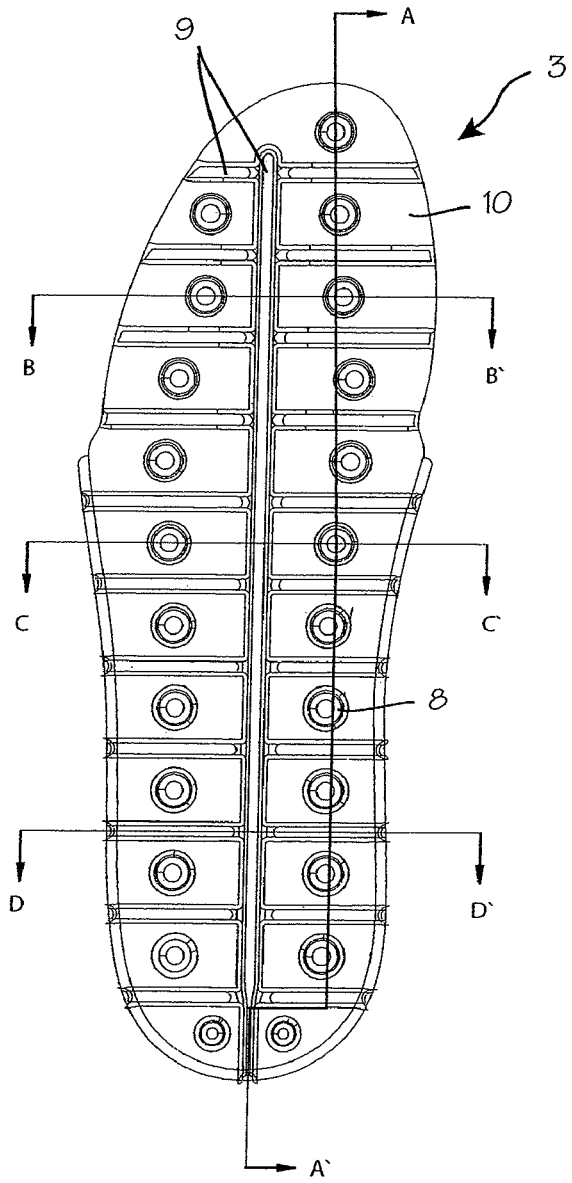
FIG. 2 illustrates a bottom view of the midsole.
Figure 2B:
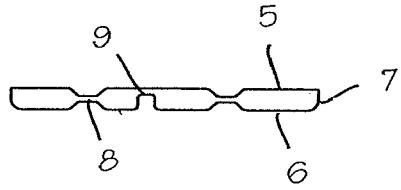
FIG. 2B illustrates a cross-sectional view of the midsole.
Figure 2C:
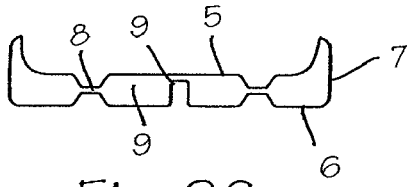
FIG. 2C illustrates a cross-sectional view of the midsole.
Figure 2D:
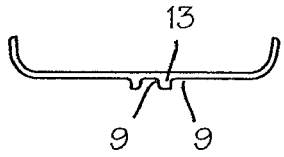
FIG. 2D illustrates a cross-sectional view of the midsole.

FIG. 1 illustrates a lateral view of a right foot skateboard shoe 1. The skateboard shoe comprises an upper 2, a midsole 3 and an outsole 4. The upper 2 is bonded to the midsole 3 and the midsole 3 is bonded to the outsole 4. FIG. 2 illustrates a bottom view of the midsole 3. As illustrated in FIG. 2 and in sectional views FIG. 2B, FIG. 2C and FIG. 2D, the midsole 3 has an upper wall 5, a bottom wall 6 and an outer wall 7.

Figure 3:
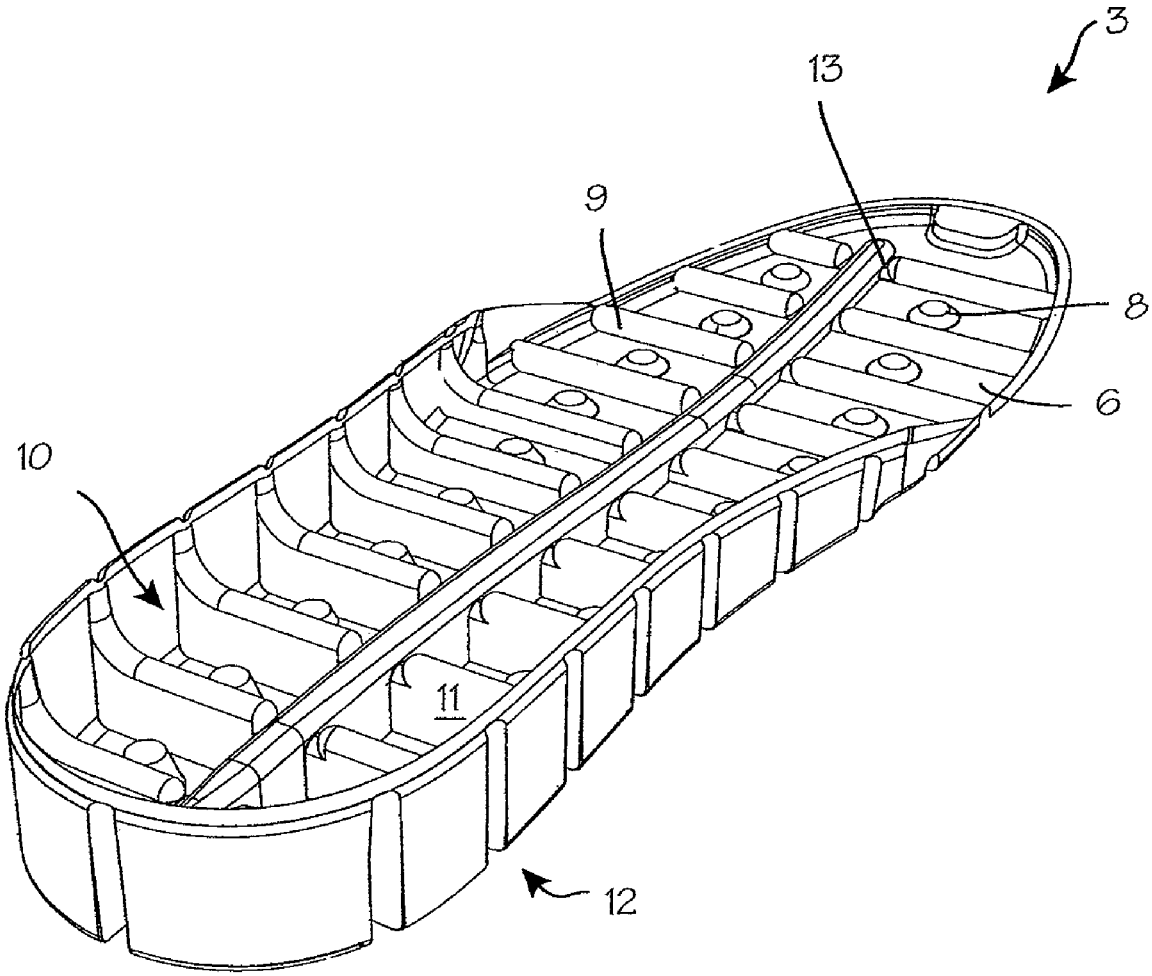
FIG. 3 illustrates the midsole with the upper wall removed for clarity.

FIG. 3 illustrates the midsole 3 with the upper wall removed for clarity. A plurality of truncated conical-shaped supports 8 extend from the upper wall (not shown) and the bottom wall provide columnar support to the user's foot. The midsole 3 comprises a plurality of barrier ribs 9 extending from the bottom wall 6 segmenting the midsole in a longitudinal and a transverse direction. The midsole 3 is segmented into a plurality of fluid chambers or cells 10 by the ribs. The ribs 9 are hollow and characterize sidewalls 11 of the chambers. A fluid chamber or cell 10 is characterized by the upper wall 5, the bottom wall 6 and sidewalls 11. Because the ribs 9 are hollow, a plurality of troughs 12 or spaces are provided between the fluid chambers at the bottom portion of the midsole. Pathways 13 between the ribs are provided to place the fluid chambers in fluid communication with one another. The fluid chambers contain any suitable gas, liquid or gel to provide an air-cushion effect. The troughs 12 between the fluid chambers 10 allow the chambers to move and flex independently from one another along the bottom portion of the midsole.

Figure 4:
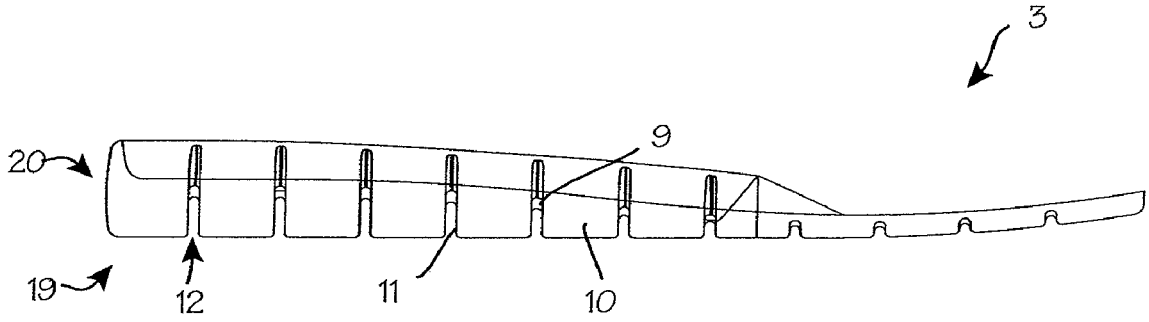
FIG. 4 illustrates a lateral view of the midsole.

FIG. 4 illustrates a lateral view of the midsole 3. The ribs 9 divide the midsole into several longitudinally spaced rows of chambers 10. The fluid filled chambers 10 provide impact protection to the wearer. The upper wall of the midsole 3 is joined to upper surfaces of the rib and the outer wall to complete the fluid chambers. Troughs separate the sidewalls of the chambers at the bottom portion 19 of the midsole. Thus, the chambers 10 are not connected to one another at the bottom portion 19. This configuration connects the chambers to one another at the top portion 20 of the midsole while allowing the chambers 3 to flex or separate relative to one another at the bottom portion 19 of the midsole.

The longitudinally spaced rows of fluid chambers 10 can flex along with the natural motion of the rider's foot while providing impact cushioning. Furthermore, the longitudinally spaced rows of fluid chambers 10 stabilize the rider's foot when the foot is in motion. Thus, the midsole 3 acts as both a stabilizing midsole 3 and an impact cushioning midsole 3 while improving the fit of the shoe so it moves with the foot.

The ribs 9 are integrally formed with the bottom wall and the outer wall of the midsole. Alternatively, ribs 9 may be bonded to the bottom wall and the outer wall surface by an adhesive or thermal bonding. Suitable materials for the midsole include thermoplastics such as thermoplastic urethane.

Figure 5:
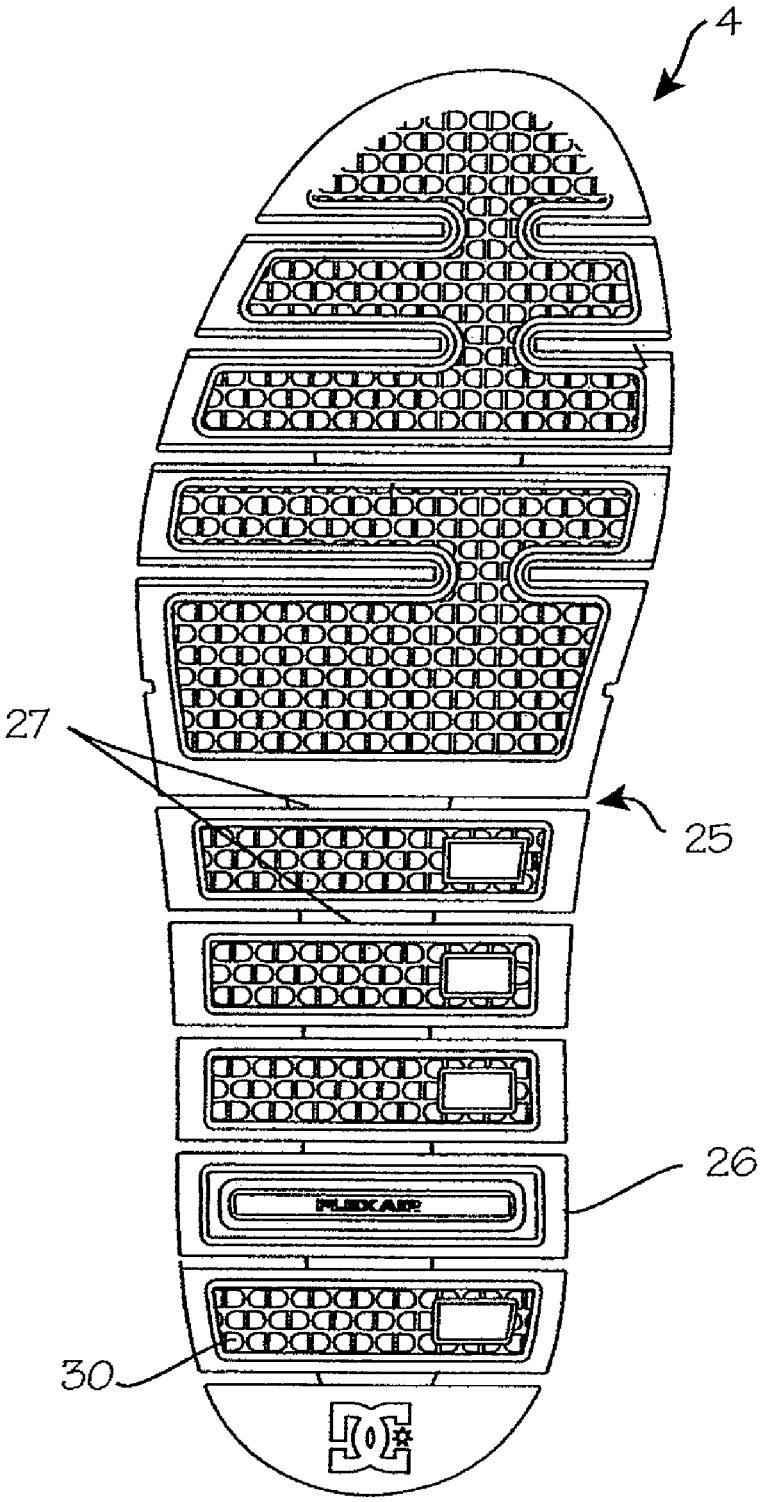
FIG. 5 illustrates a bottom view of the outsole.
Figure 6:
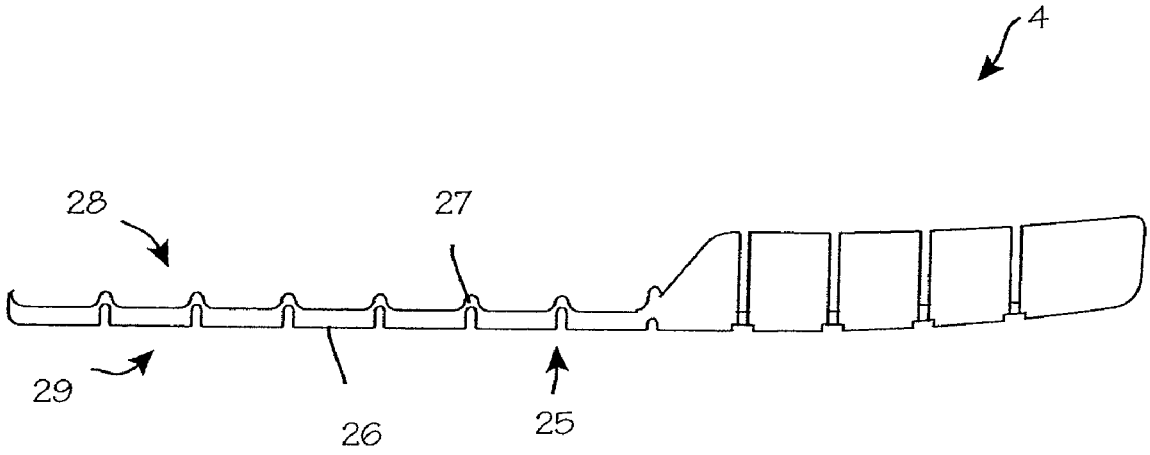
FIG. 6 illustrates a lateral view of the outsole.

FIG. 5 illustrates a bottom view of the outsole 4. The outsole of the shoe is provided with lateral partitions or gaps of material 25 segmenting the outsole longitudinally. The gaps 25 in the outsole substantially coincide with the troughs 12 of the midsole. The outsole segments 26 formed in the outsole are disposed below the longitudinally spaced fluid chambers 10 and bonded to the outer bottom surface of midsole 3 by an adhesive or through other means. Bridges 27 or webs material disposed between the individual segments connect the upper portion 28 of the segments 26 of the outsole to one another. FIG. 6 illustrates a lateral view of the outsole 4. Because the segments are only connected to one another through the bridge of material at the top portion 28 of the outsole 4, the segments are able to move and flex independent of one another at the bottom portion of the outsole 29.

The longitudinally spaced segments 26 in the outsole along with the longitudinally spaced rows of fluid chambers can flex along with the natural motion of the rider's foot while providing impact cushioning. Thus, the midsole 3 and the outsole 4 act to improve the fit of the shoe so it moves with the foot. The outsole 4 may be manufactured from natural rubber, synthetic rubber, thermoplastic rubber or other elastomers. The bottom surface of the outsole 4 is provided with a tread pattern 30 adapted to increase the amount of friction or grip between the shoe 1 and a skateboard. (Although our trademark tread pattern is shown, any tread pattern may used.)

Figure 7:
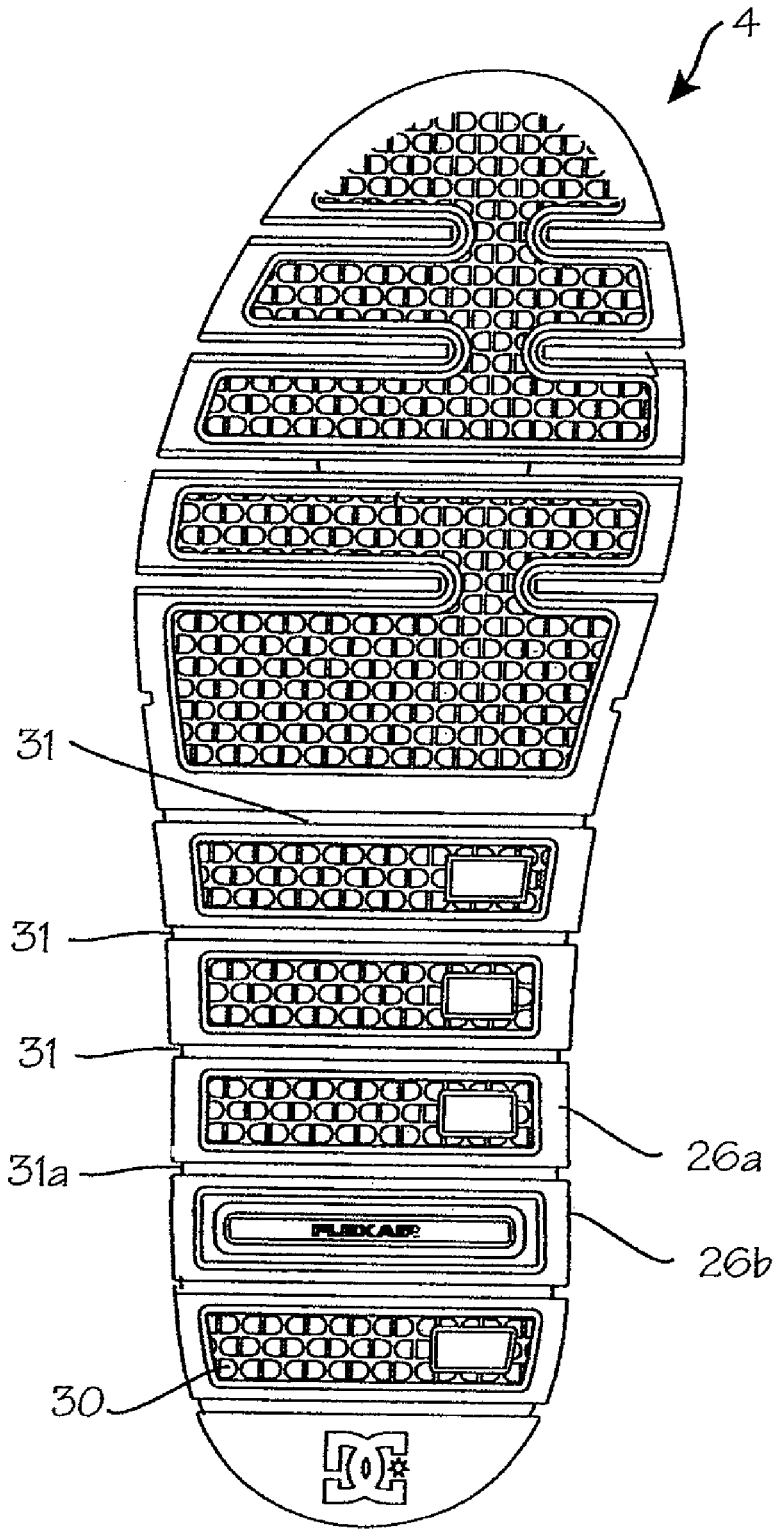
FIG. 7 illustrates an outsole for use with the segmented midsole of FIGS. 3 and 4, wherein the outsole comprises several segments which are attached by webs of substantially the same width as the outsole segments.

FIG. 7 illustrates an outsole for use with the segmented midsole of FIGS. 3 and 4, wherein the outsole comprises several segments which are attached by webs of substantially the same width as the outsole segments. As shown in FIG. 7, the partitions may comprise a thin web 31 of elastomeric material at the upper portion of the outsole connecting longitudinally spaced segments of the outsole without gaps of material. The webs in FIG. 7 are essentially co-extensive in width with the immediately outsole segments. For example, web 31*a* extended laterally across the sole, is almost as wide as neighboring outsole segments 26*a* and 26*b*.

Figure 8:
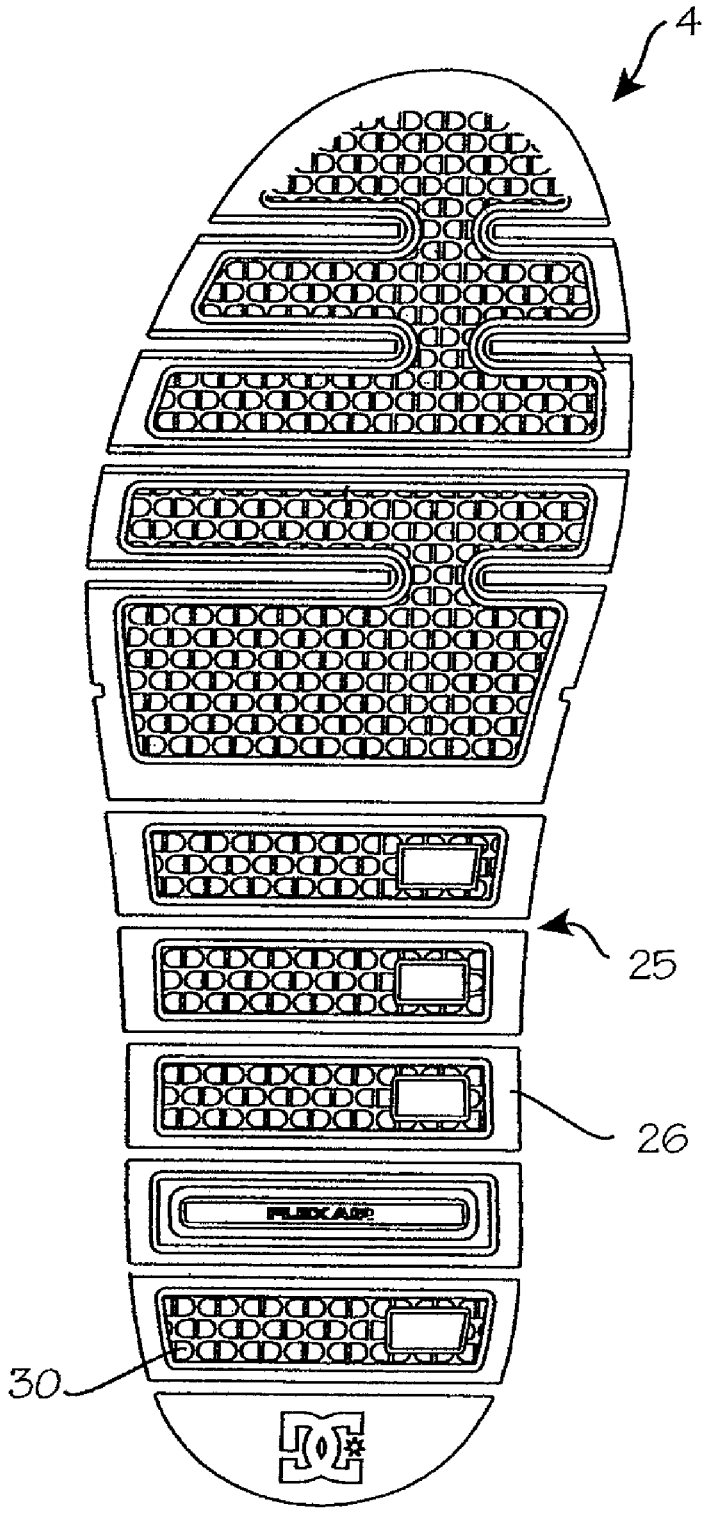
FIG. 8 illustrates an outsole for use with the segmented midsole of FIGS. 3 and 4, wherein the outsole comprises several segments which are discrete and unattached to each other.

FIG. 8 illustrates an outsole for use with the segmented midsole of FIGS. 3 and 4, wherein the outsole comprises several segments which are discrete and unattached to each other. The partitions 25 between adjacent outsole segments comprise complete gaps of material between the outsole segments 26. In this embodiment, the outsole segments are separate and unattached to adjacent outsole segments (except indirectly through the mutual attachment to the midsole).

According the description above, the shoes incorporate a midsole which comprises a plurality of fluid chambers, with each of the chambers being longitudinally fixed to adjacent chambers near the top of the chambers, while being detached and longitudinally displaceable near the bottom of the chambers. The outsole comprises a plurality of outsole segments, and each outsole segment is sized and dimensioned to cover the bottom surface of a corresponding fluid chambers. One or more elastomeric bridge members are used to connect adjacent outsole segments. The bridge members are preferably more flexible than the outsole segments (which are preferably tough enough to withstand extended street wear). The flexibility of the bridge members may be achieved by making them of a material of low modulus of elasticity relative to the outsole segments, or by reducing the width or thickness of the bridge members to achieve a low spring strength relative to the outsole segments.

In addition to skateboarding shoes, the flexible midsole 3 and outsole 4 may be used in hiking boots, snowboarding boots, running shoes, basketball shoes, BMX shoes and sandals. The components of the shoe have been described with reference to the common construction of athletic shoes, with common terms such as the sole and mid-sole. However, the various components may be made separately and assembled thereafter (as illustrated), or manufactured integrally with one another, such that, for example, the outsole and midsole components are formed together and do not have discrete boundaries. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

The previous description of the disclosed examples is provided to enable any person of ordinary skill in the art to make or use the disclosed apparatus. Various modifications to these examples will be readily apparent to those skilled in the art, and the principles defined herein may be applied to other examples without departing from the spirit or scope of the disclosed apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A shoe comprising:

a midsole including a plurality of hollow ribs longitudinally spaced defining a plurality of hollow fluid chambers that are longitudinally spaced, the plurality of hollow ribs including a first hollow rib that is longitudinally spaced, and a second hollow rib that is longitudinally spaced, wherein the second hollow rib is substantially parallel to the first hollow rib, and the first hollow rib and the second hollow rib define one of the plurality of fluid chambers, and a support unit located within the one of the plurality of fluid chambers defined by the first hollow rib and the second hollow rib; and an outsole connected to the midsole including a plurality of segments that are longitudinally spaced and disposed below the plurality of hollow fluid chambers.

2. The shoe of claim 1 wherein the plurality of hollow fluid chambers are coupled to one another along a top portion of the midsole.

3. The shoe of claim 1 wherein each of the plurality of hollow fluid chambers contain a fluid selected from the group consisting of an inert gas, an inert liquid and a gel.

4. The shoe of claim 1 further comprising a bridge member disposed between at least two of the plurality of segments in the outsole.

5. The shoe of claim 4 further comprising one or more elastomeric bridge members connecting adjacent outsole segments.

6. The shoe of claim 5 wherein the one or more elastomeric bridge members comprise a material of low modulus of elasticity relative to the outsole segments.

7. The shoe of claim 5 wherein the one or more elastomeric bridge members comprise a material of low spring strength relative to the outsole segments.

8. The shoe of claim 5 wherein the one or more elastomeric bridge members are formed integrally with the outsole segments, wherein the outsole segments are characterized by a lateral width relative to the shoe and the one or more elastomeric bridge members are characterized by a lateral width relative to the shoe, wherein the lateral width of at least one bridge member is smaller than the lateral width of adjacent outsole segments.

9. The shoe of claim 5 wherein the one or more elastomeric bridge members are formed integrally with the outsole segments, wherein the outsole segments are thicker than the one or more elastomeric bridge members, wherein the one or more elastomeric bridge members are more flexible than the outsole segments.

10. The shoe of claim 1 further comprising a web disposed between at least two of the plurality of segments in the outsole.

11. A shoe comprising:

a midsole including a plurality of hollow ribs that are longitudinally spaced segmenting the midsole into a plurality of hollow fluid chambers and characterizing a plurality of troughs in a bottom portion of the midsole, a first hollow rib that is longitudinally spaced, a second hollow rib that is longitudinally spaced, the second hollow rib substantially parallel to the first hollow rib and defining at least one of the plurality of hollow fluid chambers, and a support unit located within the at least one of the plurality of hollow fluid chambers defined by the first hollow rib and the second hollow rib; and an outsole connected to the midsole including a plurality of segments that are longitudinally spaced.

12. The shoe of claim 11 further comprising a bridge member disposed between at least two of the plurality of segments in the outsole.

13. The shoe of claim 11 further comprising a web disposed between at least two of the plurality of segments in the outsole.

14. A shoe comprising:

an upper;

a midsole connected to the upper including a top portion, a bottom portion, a first hollow rib, a second hollow rib substantially parallel to the first hollow rib, the first hollow rib and the second hollow rib defining a first hollow fluid chamber that is longitudinally spaced, a third hollow rib, a fourth hollow rib that is substantially parallel to the third hollow rib, the third hollow rib and the fourth hollow rib defining a second hollow fluid chamber that is longitudinally spaced, wherein the first hollow fluid chamber and the second hollow fluid chamber are connected at the top portion and the first hollow fluid chamber and the second hollow fluid chamber are able to flex independently of each other along the bottom portion, a first support unit located within the first hollow fluid chamber, and a second support unit located within the second hollow fluid chamber; and an outsole connected to the midsole including a first segment disposed below the first hollow fluid chamber, the first segment being longitudinally spaced and able to flex with the first hollow fluid chamber, and a second segment disposed below the second hollow fluid chamber, the second segment being longitudinally spaced and able to flex with the second hollow fluid chamber.

15. The shoe of claim 14 further comprising a bridge member formed integrally with the first segment and the second segment connecting the first segment and the second segment.

16. The shoe of claim 15 wherein a lateral width of the bridge member is smaller than a lateral width of the first segment and a lateral width of the second segment, the first segment and the second segment have a thickness greater than a thickness of the bridge member, and the bridge member is more flexible than the first segment and the second segment.

17. The shoe of claim 15 wherein the bridge member is an elastomeric bridge member.

18. The shoe of claim 17 wherein the bridge member comprises a material of low spring strength relative to the first segment and the second segment.

19. The shoe of claim 18 wherein the first fluid chamber and the second fluid chamber comprise a fluid selected from the group consisting of an inert gas, an inert liquid and a gel.

20. The shoe of claim 17 wherein the bridge member comprises a material of low modulus of elasticity relative to the first segment and the second segment.

* * * * *